US011454042B2

(12) United States Patent
Wyse et al.

(10) Patent No.: US 11,454,042 B2
(45) Date of Patent: Sep. 27, 2022

(54) ELEVATED FLOORING SYSTEM FOR CLEARSPAN TENT

(71) Applicant: Granite Industries, Inc., Archbold, OH (US)

(72) Inventors: Steven J. Wyse, Naples, FL (US); Brent A. Johnston, West Unity, OH (US)

(73) Assignee: Granite Industries, Inc., Archbold, OH (US)

( * ) Notice: Subject to any disclaimer, the term of this patent is extended or adjusted under 35 U.S.C. 154(b) by 0 days.

(21) Appl. No.: 17/548,349

(22) Filed: Dec. 10, 2021

(65) Prior Publication Data

US 2022/0098895 A1 Mar. 31, 2022

Related U.S. Application Data

(63) Continuation of application No. 17/378,453, filed on Jul. 16, 2021.

(60) Provisional application No. 63/052,997, filed on Jul. 17, 2020.

(51) Int. Cl.
*E04H 15/56* (2006.01)
*E04B 5/10* (2006.01)

(52) U.S. Cl.
CPC ..... *E04H 15/56* (2013.01); *E04B 5/10* (2013.01)

(58) Field of Classification Search
CPC ..... E04B 1/38; E04B 1/5818; E04B 5/023; E04B 5/10; E04H 15/16
USPC ..... 52/578
See application file for complete search history.

(56) References Cited

U.S. PATENT DOCUMENTS

| | | | | |
|---|---|---|---|---|
| 2,956,653 A | | 10/1960 | Liskey, Jr. | |
| 3,065,506 A | | 11/1962 | Tremer | |
| 3,068,968 A | * | 12/1962 | Herrod | B62D 33/044 403/404 |
| 3,130,470 A | * | 4/1964 | Bowden | E04G 11/48 211/186 |
| 3,150,748 A | | 9/1964 | Liskey, Jr. | |
| 3,222,030 A | | 12/1965 | Thorpe | |
| 3,324,614 A | | 6/1967 | Loewenau | |
| 3,396,501 A | | 8/1968 | Tate | |

(Continued)

FOREIGN PATENT DOCUMENTS

| | | | | |
|---|---|---|---|---|
| CN | 208486531 | | 2/2019 | |
| DE | 4301475 A1 | * | 8/1993 | B65G 1/02 |

(Continued)

*Primary Examiner* — Brian D Mattei
*Assistant Examiner* — Joseph J. Sadlon
(74) *Attorney, Agent, or Firm* — Hovey Williams LLP

(57) ABSTRACT

An elevated flooring system is operable to support a flooring panel. The elevated flooring system includes a beam configured to support the flooring panel. Aspects of the flooring system also include a saddle with a base surface and a prong. The beam is engaged with and vertically supported by the base surface of the saddle. The beam is configured to support the flooring panel and defines an aperture configured to receive the prong. Aspects of the beam includes a tent attachment assembly and a beam wall defining an aperture and opposite wall surfaces. The tent attachment assembly is configured for attachment to the tent and includes a base, a boss plate, and a threaded fastener. The fastener extends at least partly through the apertures of the base, boss plate and beam wall and is threaded into the boss plate.

15 Claims, 15 Drawing Sheets

(56) References Cited

U.S. PATENT DOCUMENTS 3,470,663 A 10/1969 Tate
3,606,704 A * 9/1971 Denton ..... E04F 15/02452 403/138
3,616,584 A 11/1971 Sartori et al.
3,847,340 A * 11/1974 Ficken ..... E04G 11/10 249/188
3,899,857 A 8/1975 Mochizuki
4,085,557 A 4/1978 Tharp
4,121,398 A * 10/1978 Hahn ..... E04B 5/10 52/646
4,427,021 A 1/1984 Cater, Sr.
4,561,165 A 12/1985 Bayer
4,630,417 A 12/1986 Collier
4,685,258 A 8/1987 Av-Zuk
4,745,715 A * 5/1988 Hardwicke ..... E04F 15/02405 D25/138
4,780,571 A 10/1988 Huang
4,893,441 A 1/1990 Catalano et al.
4,930,277 A * 6/1990 Krumholz ..... E04H 3/24 52/263
4,972,537 A * 11/1990 Slaw, Sr. ..... E04B 5/023 14/77.1
4,982,539 A 1/1991 Hiller
5,048,242 A 9/1991 Cline
5,685,662 A * 11/1997 Rollin ..... E06B 3/9642 403/231
5,983,582 A 11/1999 Vugrek
6,256,958 B1 7/2001 Matthews
6,331,092 B1 * 12/2001 Linger ..... E04B 2/761 403/403
6,427,400 B1 8/2002 Greenblatt
6,463,704 B1 10/2002 Jette
6,502,362 B1 * 1/2003 Zambelli ..... E04B 1/41 52/378
6,519,902 B1 2/2003 Scissom
6,637,161 B1 10/2003 Buchalter et al.
6,729,100 B2 5/2004 Koski et al.
6,772,564 B2 8/2004 Leon
6,941,715 B2 9/2005 Potter
7,360,343 B1 4/2008 Spransy et al.
7,373,759 B1 * 5/2008 Simmons ..... E04F 15/024 52/126.2
7,650,725 B2 1/2010 Mead
7,698,860 B2 * 4/2010 Hockemeyer ..... E04H 1/1205 182/186.7
7,866,093 B2 * 1/2011 Krovats ..... E04B 7/18 52/90.2
7,980,042 B2 * 7/2011 Polk, Jr. ..... B29C 31/047 403/252
8,365,475 B2 2/2013 Zlatar
8,490,234 B2 7/2013 Rowell et al.
8,769,899 B2 * 7/2014 Barry ..... E04F 15/02452 52/480
9,038,324 B2 5/2015 Kugler et al.
9,212,483 B2 12/2015 Permesang
9,273,464 B2 3/2016 Roen
10,047,528 B1 8/2018 Kim
10,246,868 B2 * 4/2019 Pridham ..... E04B 5/14
10,487,469 B2 11/2019 Reusing
10,508,467 B2 12/2019 Francis
10,538,923 B2 1/2020 Marchetti et al.
10,570,626 B1 2/2020 Kim
10,781,605 B2 9/2020 Francis
11,142,925 B2 10/2021 Francis
2002/0070092 A1 * 6/2002 Ransil ..... B65G 13/12 193/37
2003/0213191 A1 11/2003 Jette
2004/0020154 A1 * 2/2004 Greschbach ..... E04H 3/28 52/582.1
2005/0066597 A1 3/2005 Chen et al.
2009/0205275 A1 8/2009 Isaac
2013/0043095 A1 2/2013 Thacker
2019/0338540 A1 11/2019 Cerasi et al.

FOREIGN PATENT DOCUMENTS

DE 19911380 A1 9/2000
EP 0770743 5/1997
EP 0965706 12/1999
EP 1760222 3/2007
EP 2050895 4/2009
EP 2407614 1/2012
EP 3216942 9/2017
EP 3216942 A1 * 9/2017
FR 2585752 A1 2/1987
GB 933016 7/1963
WO 9117330 11/1991
WO 9119063 12/1991
WO WO-0037745 A1 * 6/2000 ..... E04B 5/10
WO 2007061199 A1 5/2007
WO WO-2007106923 A1 * 9/2007 ..... E04B 1/24
WO 2011089239 A1 7/2011
WO 2012017458 A1 2/2012
WO 2012108779 A1 8/2012
WO 2018172011 A2 9/2018
WO 2020065519 A1 4/2020

* cited by examiner

ELEVATED FLOORING SYSTEM FOR CLEARSPAN TENT

CROSS-REFERENCE TO RELATED APPLICATIONS

This is a continuation of U.S. application Ser. No. 17/378,453, filed Jul. 16, 2021, entitled ELEVATED FLOORING SYSTEM FOR CLEARSPAN TENT, which application claims the benefit of U.S. Provisional Application Ser. No. 63/052,997, filed Jul. 17, 2020, entitled ELEVATED FLOORING SYSTEM FOR CLEARSPAN TENT, each of which is hereby incorporated in its entirety by reference herein.

BACKGROUND

1. Field

The present invention relates generally to platforms and elevated flooring support structures. More specifically, embodiments of the present invention concern an elevated flooring configured to support a clearspan tent.

2. Discussion of Prior Art

Conventional elevated platform structures include a deck supported by an underlying framework. The framework generally has a series of upright legs arranged in a uniform spacing along the span of the deck. Prior art platforms often include a plurality of deck sections that cooperatively provide the floor and are supported by an array of underlying beams. In at least some known embodiments, a series of underlying beams may be directly attached to one another to provide a continuous beam assembly. Platform structures for supporting a tent are known to have multiple tent connection structures located on top of the beams for attaching the beams to poles of the tent.

Prior art elevated platform structures and elevated tent support structures are known to have various deficiencies. For example, conventional beams attached directly to one another in series are notably difficult and time consuming to assemble and disassemble. Known beam assemblies have a tent connection structure that also involves a laborious and complicated assembly process. Furthermore, assembly of the beams and the tent connection structures involves an excessively large number of components, particularly fasteners.

This background discussion is intended to provide information related to the present invention which is not necessarily prior art.

SUMMARY

The following brief summary is provided to indicate the nature of the subject matter disclosed herein. While certain aspects of the present invention are described below, the summary is not intended to limit the scope of the present invention.

Embodiments of the present invention provide an elevated flooring system that does not suffer from the problems and limitations of prior art devices, including those set forth above.

A first aspect of the present invention concerns an elevated flooring system operable to support a flooring panel. The elevated flooring system broadly includes a saddle and a plurality of beams. The saddle includes a base surface and a plurality of prongs extending upwardly away from the base surface. The beams are engaged with and vertically supported by the base surface of the saddle. Each beam is configured to support the flooring panel and defines an aperture configured to receive a respective one of the plurality of prongs. Each prong extends through a respective one of the apertures to restrict horizontal movement of the corresponding beam relative to the saddle.

A second aspect of the present invention concerns an elevated flooring system operable to support a flooring panel and to engage a tent assembled atop the elevated flooring system. The elevated flooring system broadly includes a beam configured to support the flooring panel. The beam includes a tent attachment assembly and a beam wall defining an aperture and opposite wall surfaces. The tent attachment assembly is configured for attachment to the tent and includes a base, a boss plate, and a threaded fastener. The base and the boss plate are respectively located along the wall surfaces of the beam wall and each present an aperture. The apertures of the base, boss plate and beam wall are substantially aligned. The fastener extends at least partly through the apertures of the base, boss plate and beam wall and is threaded into the boss plate, with the fastener and boss plate cooperatively providing a clamping engagement about the opposite wall surfaces of the beam wall to secure the tent attachment assembly.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

The figures described below depict various aspects of systems and methods disclosed therein. It should be understood that each figure depicts an embodiment of a particular aspect of the disclosed systems and methods, and that each of the figures is intended to accord with a possible embodiment thereof. Further, wherever possible, the following description refers to the reference numerals included in the following figures, in which features depicted in multiple figures are designated with consistent reference numerals.

Figure 1A:
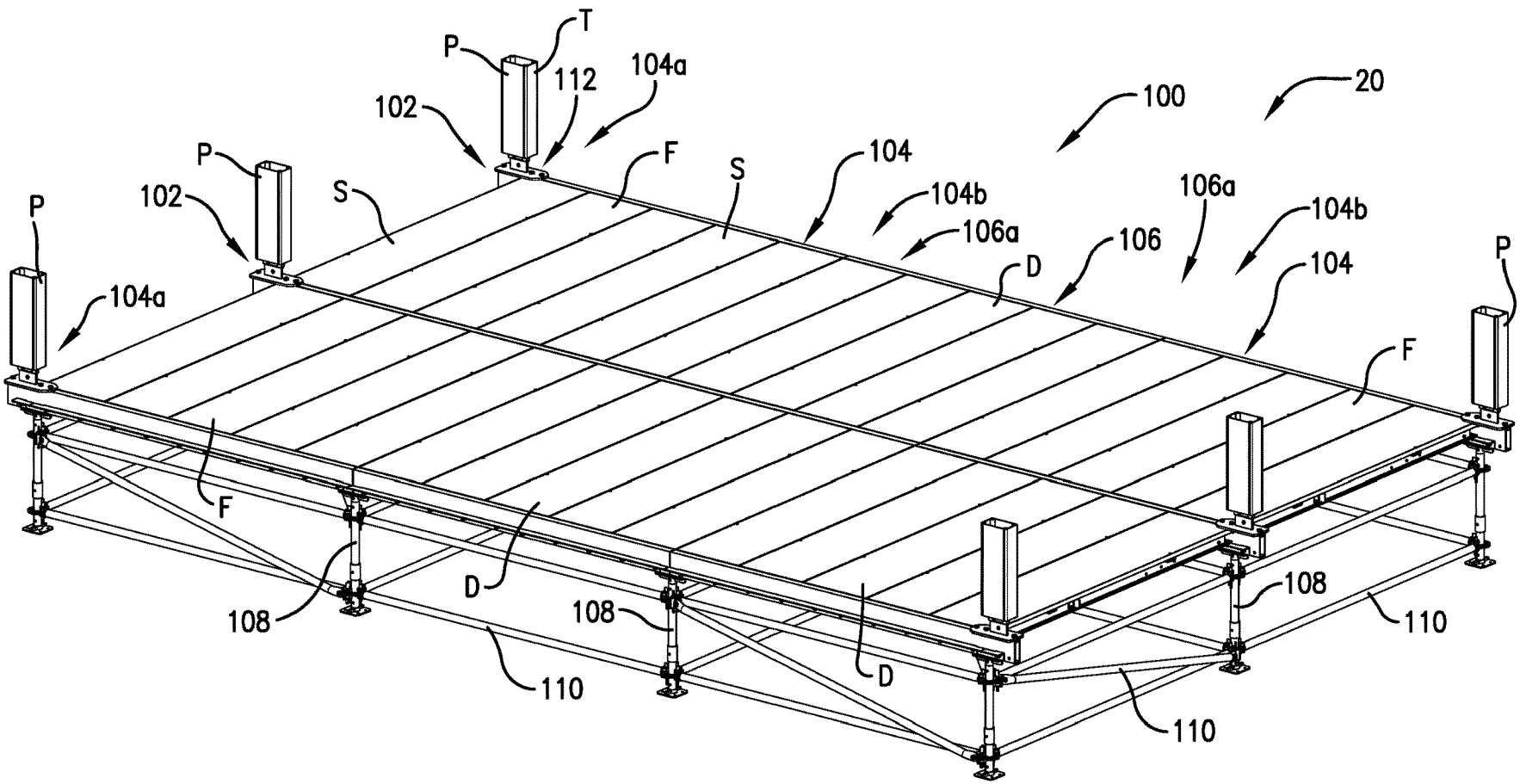
FIG. 1A is a fragmentary perspective of a clearspan tent assembly constructed in accordance with a preferred embodiment of the present invention, showing an exemplary elevated flooring system supporting an array of flooring panels and a clearspan tent with poles.

Unless otherwise indicated, the figures provided herein are meant to illustrate features of embodiments of this disclosure. These features are believed to be applicable in a wide variety of systems comprising one or more embodiments of this disclosure. As such, the figures are not meant to include all conventional features known by those of ordinary skill in the art to be required for the practice of the embodiments disclosed herein.

The drawing figures do not limit the present invention to the specific embodiments disclosed and described herein. While the drawings do not necessarily provide exact dimensions or tolerances for the illustrated components or structures, the drawings, not including any purely schematic drawings, are to scale with respect to the relationships between the components of the structures illustrated therein.

DETAILED DESCRIPTION OF THE PREFERRED EMBODIMENTS

The present invention is susceptible of embodiment in many different forms. While the drawings illustrate, and the specification describes, certain preferred embodiments of the invention, it is to be understood that such disclosure is by way of example only. There is no intent to limit the principles of the present invention to the particular disclosed embodiments.

Figure 1B:
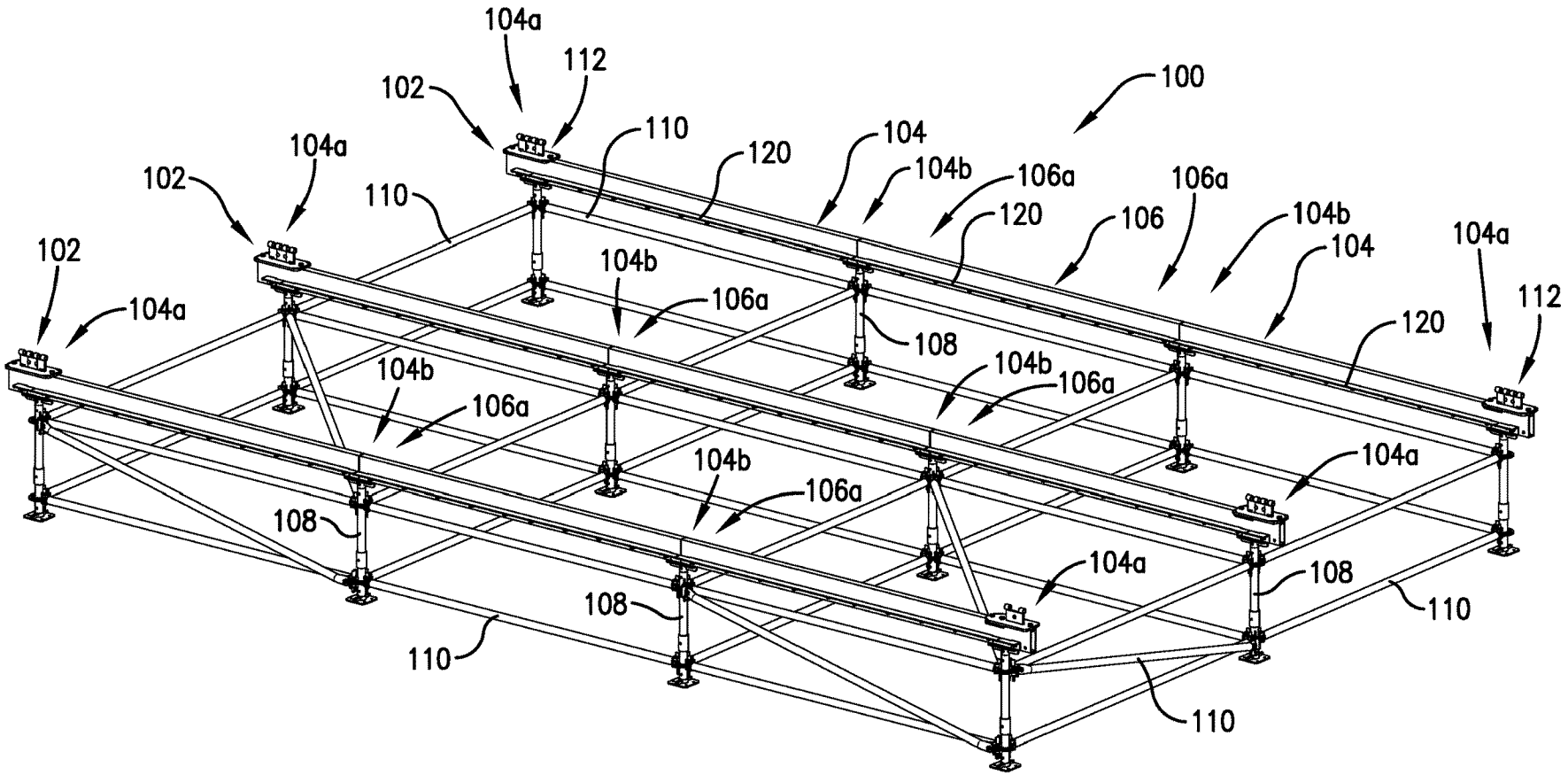
FIG. 1B is a fragmentary perspective of the clearspan tent assembly similar to FIG. 1A, but showing the flooring panels and clearspan tent removed to depict the elevated flooring system, with the flooring system including three (3) sets of beams supported by legs stabilized with braces, each set comprising two (2) end beams and one (1) intermediate beam.
Figure 2:
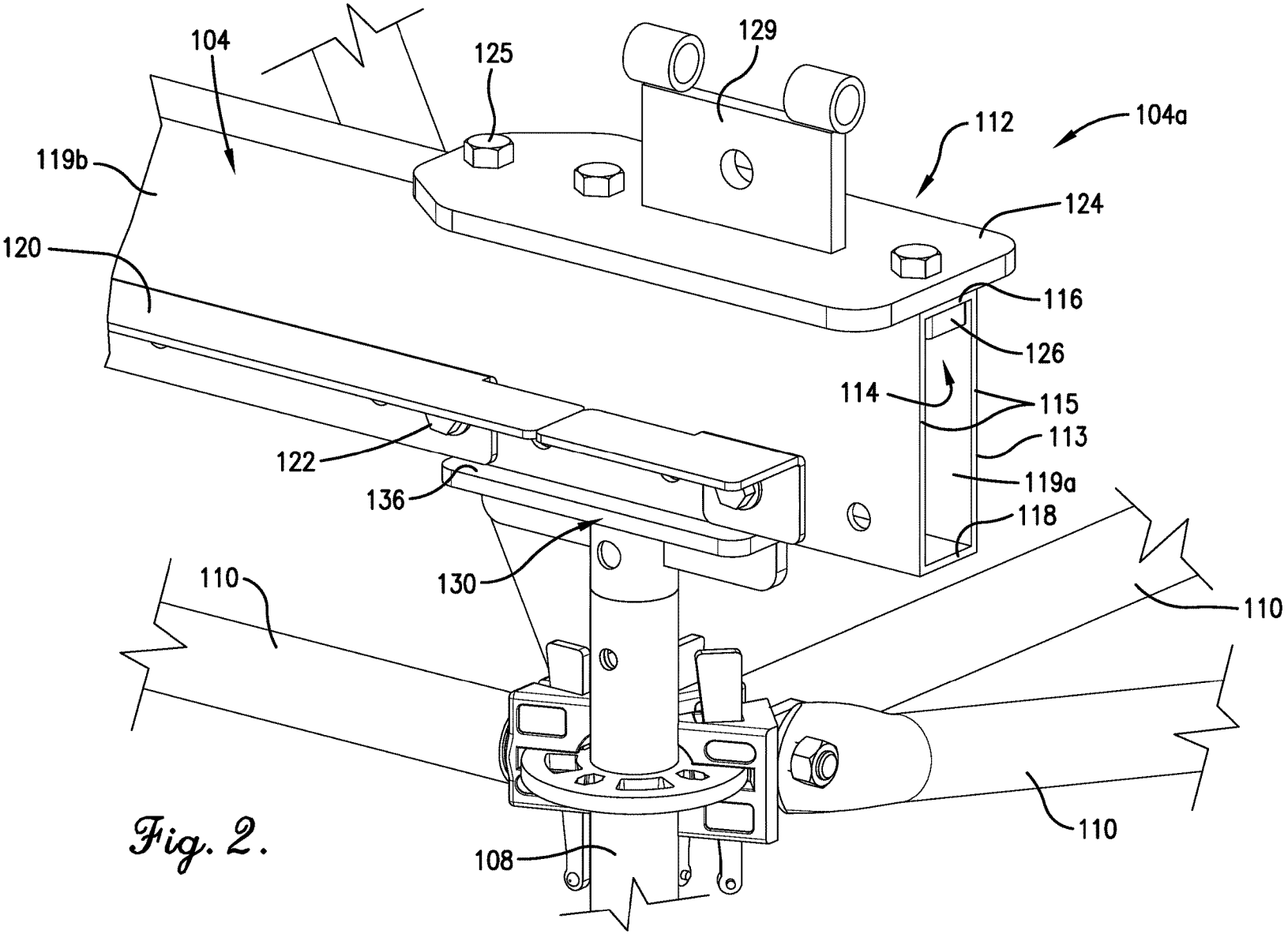
FIG. 2 is an enlarged partial perspective view of an outboard end of one of the end beams shown in FIG. 1B, the end beam being supported by a saddle and the saddle being supported by a leg stabilized with braces, with the end beam including a tubular member, flooring shelves, and a tent attachment assembly.
Figure 3:
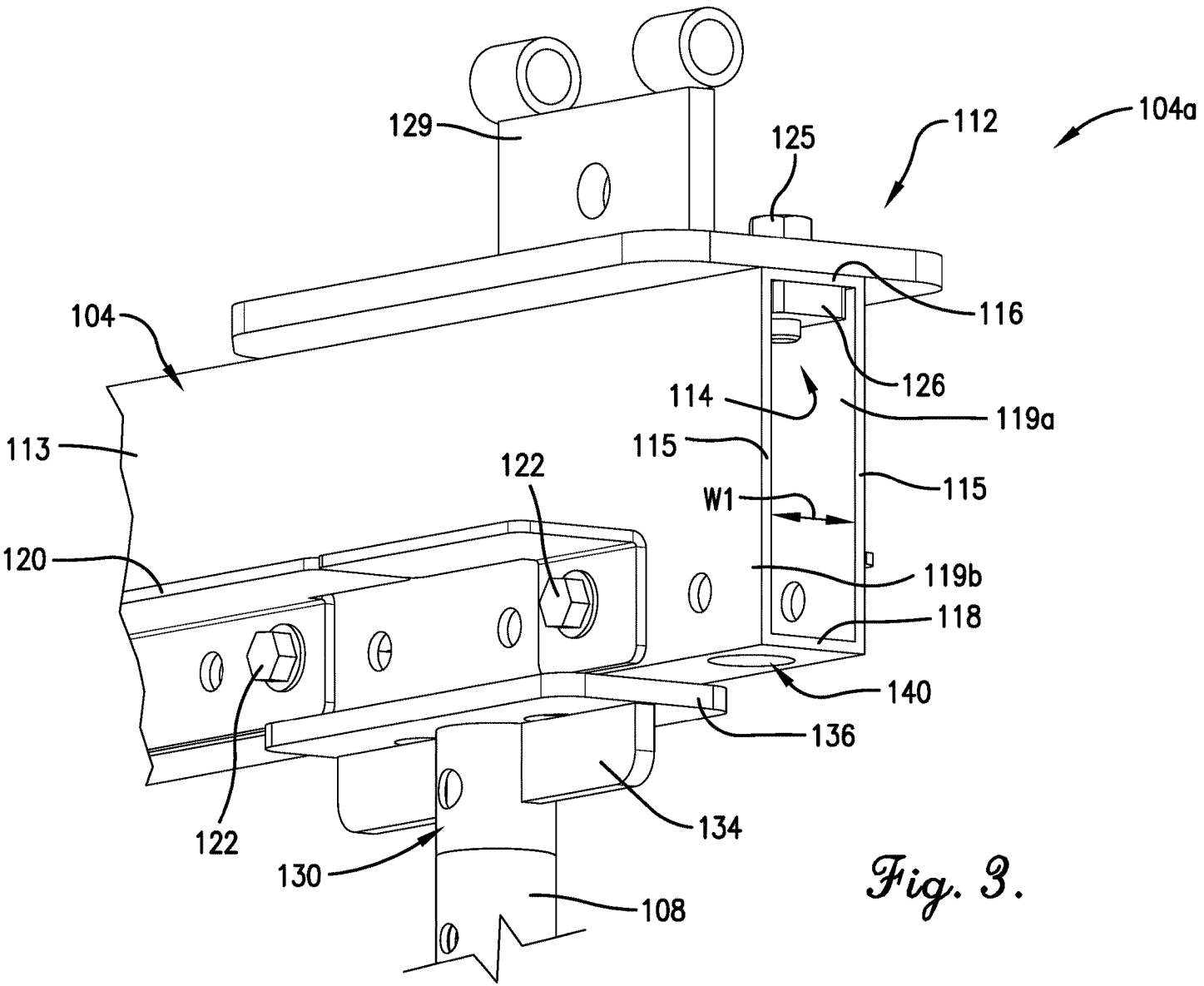
FIG. 3 is a de-elevated view of the outboard end of the end beam and supporting structure shown in FIG. 2.
Figure 4:
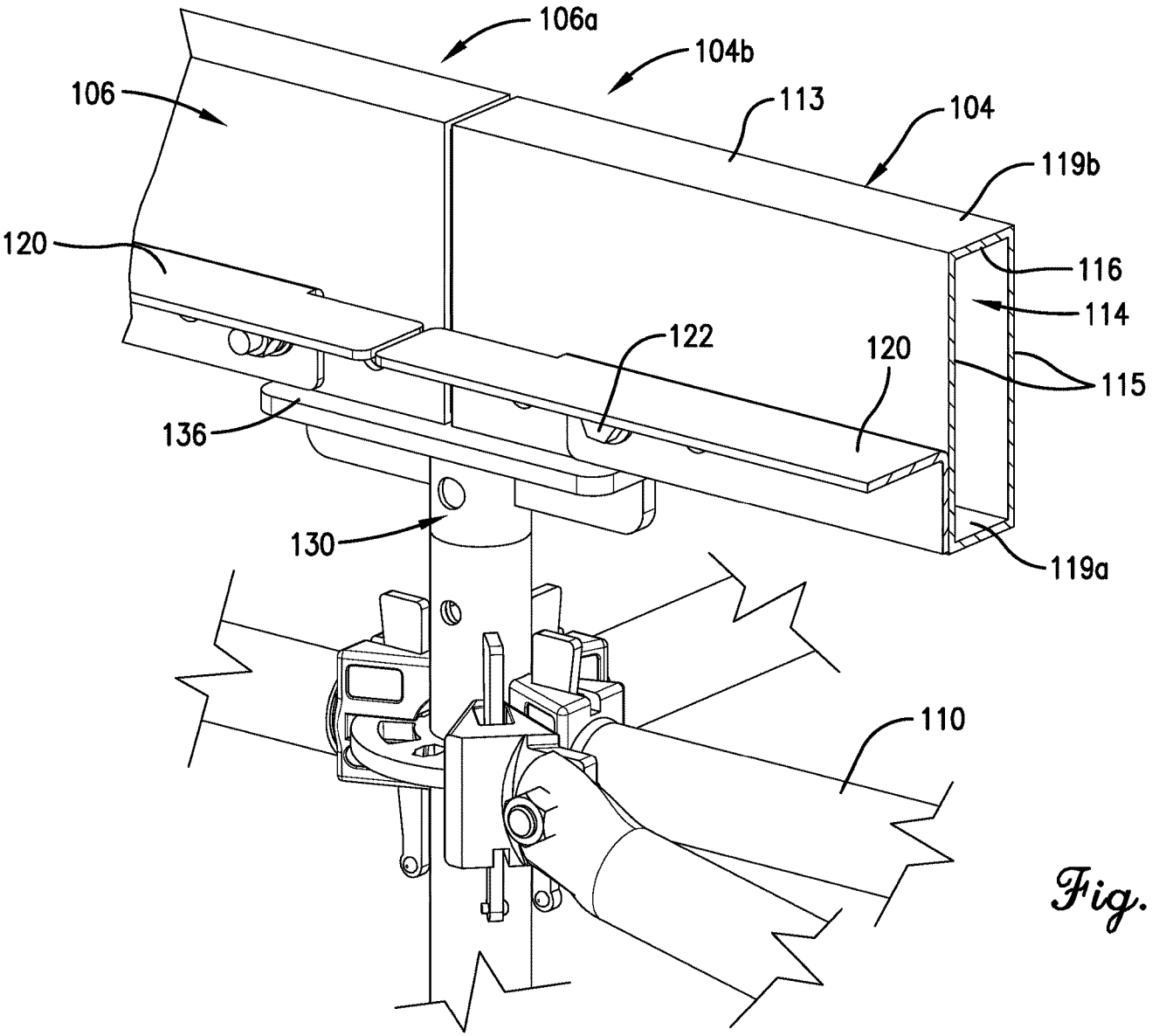
FIG. 4 is a partial perspective view of a juncture between an end beam and intermediate beam of a set of beams shown in FIG. 1B, the end beam and the intermediate beam being supported by a saddle and the saddle being supported by a leg stabilized with braces.
Figure 5:
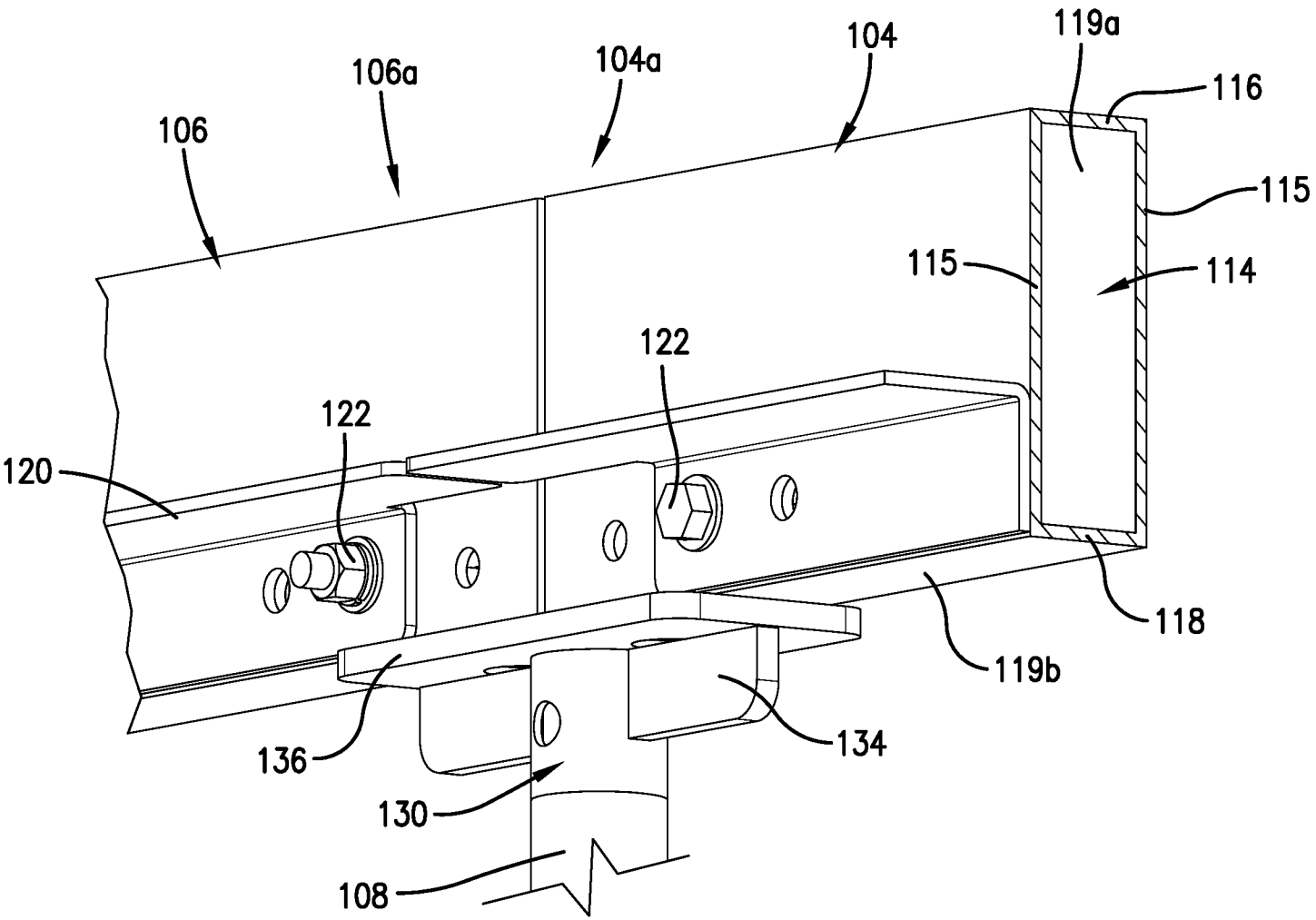
FIG. 5 is a de-elevated view of the juncture between end beam and intermediate beam, together with supporting structure, shown in FIG. 4.
Figure 6:
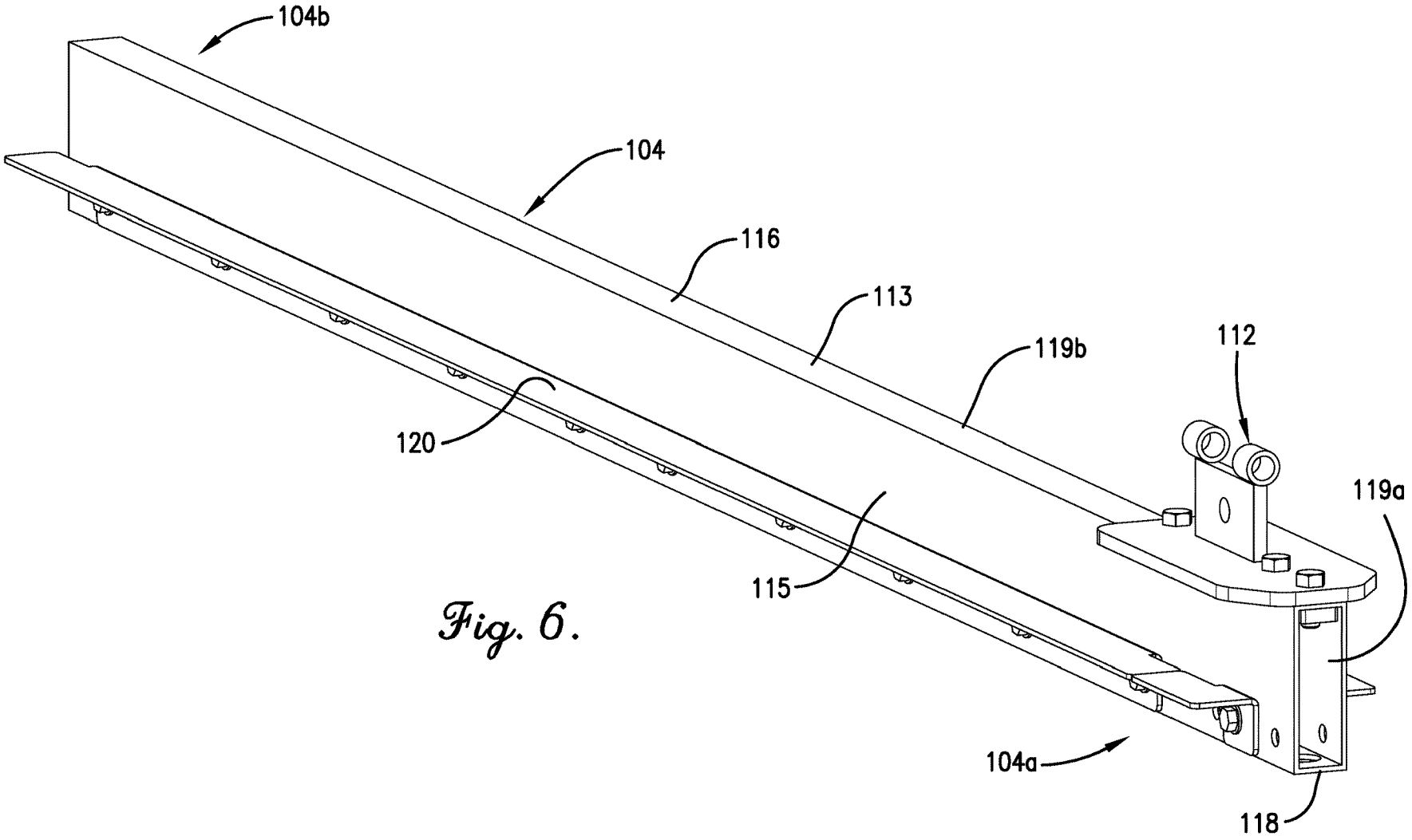
FIG. 6 is a perspective view of the end beam similar to FIG. 2, but showing an alternative orientation of the tent attachment assembly where the tent attachment assembly is rotated end-for-end.

Turning initially to FIGS. 1A and 1B, a clearspan tent assembly 20 includes an exemplary elevated flooring system 100, which supports an array of floor panels F and a clearspan tent T. The elevated flooring system 100 includes three (3) sets 102 of longitudinally-extending beams (see FIG. 1B). Each set 102 includes two (2) end beams 104 and an intermediate beam 106. It should be appreciated that any number of intermediate beams 106 may be interposed between end beams 104 to form a set, and that any number of sets may be utilized to increase area available for flooring, according to varying embodiments of the present invention. Furthermore, in alternative embodiments, adjacent longitudinally extending sets may be interconnected by one or more laterally extending beams. For instance, as will be discussed below, a laterally extending beam may be attached to a juncture of two beams of a particular set.

Although the depicted beams of each set are preferably coaxially arranged relative to one another, alternative sets of beams may include a beam that is not coaxial relative to another beam. For instance, beams of a particular set may be arranged perpendicularly or at an oblique angle relative to one another. It will also be appreciated that beams of a particular set may be laterally offset and parallel to one another.

Turning to FIGS. 1A-3 and 6-8, each end beam 104 presents outboard and inboard beam ends 104*a*, 104*b* (see FIG. 1). In the depicted flooring system 100, each outboard beam end 104*a* is located along the perimeter of the flooring system 100. Each intermediate beam 106 presents opposite beam ends 106*a*. In preferred embodiments, the beams 104, 106 of each set 102 are configured in an end-to-end arrangement, with adjacent pairs of beam ends being supported by a common saddle. For at least certain aspects of the present invention, alternative flooring system embodiments may include adjacent beams of a set that at least partly overlap with one another along a longitudinal beam direction. That is, an alternative flooring system may include adjacent beams that are at least partly coextensive with one another in the longitudinal beam direction. As described further below, each of the depicted beams 104, 106 is primarily supported by underlying support structure and/or saddle(s) without being fastened directly to or engaged in a supporting relationship with an adjacent beam 104, 106.

Again, embodiments of the system 100 are configured to support one or more flooring panels F and to engage upright poles P of the tent T, which is assembled atop the elevated flooring system 100 (see FIG. 1A). Each flooring panel F preferably includes an upper decking layer D and a panel frame (not shown) that supports the decking layer D. The decking layer D of flooring panels F cooperatively present an upper surface S of the flooring. The panel frame includes perimeter frame members (not shown) that are connected to each other and extend along the perimeter of decking layer D. The panel frame also includes spaced apart cross members that interconnect perimeter frame members extending along the long sides of the flooring panel F. It will be appreciated that alternative flooring panels are also within the ambit of certain aspects of the present invention. For instance, alternative flooring panels may have no underlying framework, may have an apertured decking layer, etc.

Each set 102 of beams is preferably configured to at least partly support one or more of the flooring panels F. However, it will be understood that various numbers and/or configurations of flooring panels may be supported by sets 102. For instance, each beam 104, 106 may be configured to support one or more flooring panels. In the depicted embodiment, adjacent pairs of beams 104, 106 of each set are supported by a common saddle, and the adjacent pairs of beams 104, 106 support respective flooring panels F. However, adjacent beams 104, 106, particularly those supported by a common saddle, may cooperatively support a common flooring panel, although such a common panel support arrangement is not required (e.g., the adjacent beams of each set may provide support to more than one (1) panel).

The beams 104, 106 are supported on support structure comprising vertical legs 108 stabilized by diagonally-, longitudinally- and transversely-extending braces 110. As will be explained, the legs 108 are attached to corresponding saddles, which support respective beams 104, 106.

Each end beam 104 preferably includes a tent attachment assembly 112 at or adjacent an outboard beam end 104*a* of the end beam 104. However, in alternative embodiments, one or more of the tent attachment assemblies may be alternatively positioned and/or supported relative to the sets of beams. For instance, an alternative set may have more or fewer tent attachment assemblies, compared to the illustrated embodiment. In alternative embodiments, one or more sets may have a greater or fewer number of tent attachment assemblies to provide a tent attachment configuration with suitable load-supporting capability, to permit tent attachment at alternative perimeter locations, and/or for other purposes. For at least certain aspects of the present invention, alternative tent attachment locations may also be provided at locations spaced within the perimeter of the flooring system without departing from the scope of the present invention.

An alternative set of beams may also present an alternative positioning of tent attachment assemblies along the length of the set. For example, it will be appreciated that alternative intermediate beam embodiments may be provided with one or more tent attachment assemblies. Also, one or more end beams may be devoid of a tent attachment assembly. For instance, attachment of a tent at the outboard ends of each set of beams may not be required in alternative flooring system embodiments (e.g., where a tent does not span the entire area of the flooring system). Preferred details of the tent attachment assemblies 112 will be discussed below.

Each of the beams 104, 106 comprises a tubular member 113 that defines an interior beam channel 114 (see FIGS. 2-5). The tubular member 113 also includes sidewalls 115, a top wall 116, and a bottom wall 118. Tubular member 113 also presents interior and exterior wall surfaces 119*a*, 119*b*. Sidewalls 115 cooperatively define an interior beam width dimension W1 of the beam channel 114 (see FIGS. 8 and 12A).

Although the illustrated beams are preferably tubular, the flooring system may include one or more alternative beams that are alternatively configured, according to certain aspects of the present invention. For instance, alternative beam embodiments may have an alternative beam cross-sectional shape, such as an L-shaped cross section (which may be provided by an angle beam section), a C-shaped cross section (which may be provided by a channel beam section), an I-shape cross section (which may be provided by an I-beam section), and/or other beam shapes.

Turning to FIGS. 2-8 and 10, flooring shelves 120 may be fixed to one or both of the sidewalls 115 of the respective beam 104, 106. Flooring panels F may be placed between the beams 104, 106 to rest on and be supported by the shelves 120.

The illustrated flooring shelves 120 comprise outturned L-brackets removably fixed to the sidewalls 115. More particularly, bottom portions of the shelves 120 define apertures 120*a* regularly spaced along their length (see FIG. 10). Each respective sidewall 115 defines corresponding apertures 115*a* regularly spaced along its length (see FIG. 10). The respective apertures 120*a*, 115*a* of the shelves 120 and of the sidewalls 115 may be aligned and the shelves 120 may be removably secured to the sidewalls 115 using fasteners 122 (see FIG. 10), such as the illustrated nuts and bolts. Removably secured shelves 120 may be replaceable, for example to allow for interchangeability of shelves presenting top (shelf) portions at varying vertical positions and/or shelves with bottom (shelf) portions. Moreover, outturned portions of the shelves 120 may comprise outturned flanges. In alternative embodiments, the outturned portions of the shelves 120 may include upturned or downturned end portions (not shown).

One of ordinary skill will appreciate that shelves may be removed or omitted from one side of a beam, may be permanently fixed to a beam, and/or may be alternatively configured without departing from the spirit of the present invention.

Figure 9:
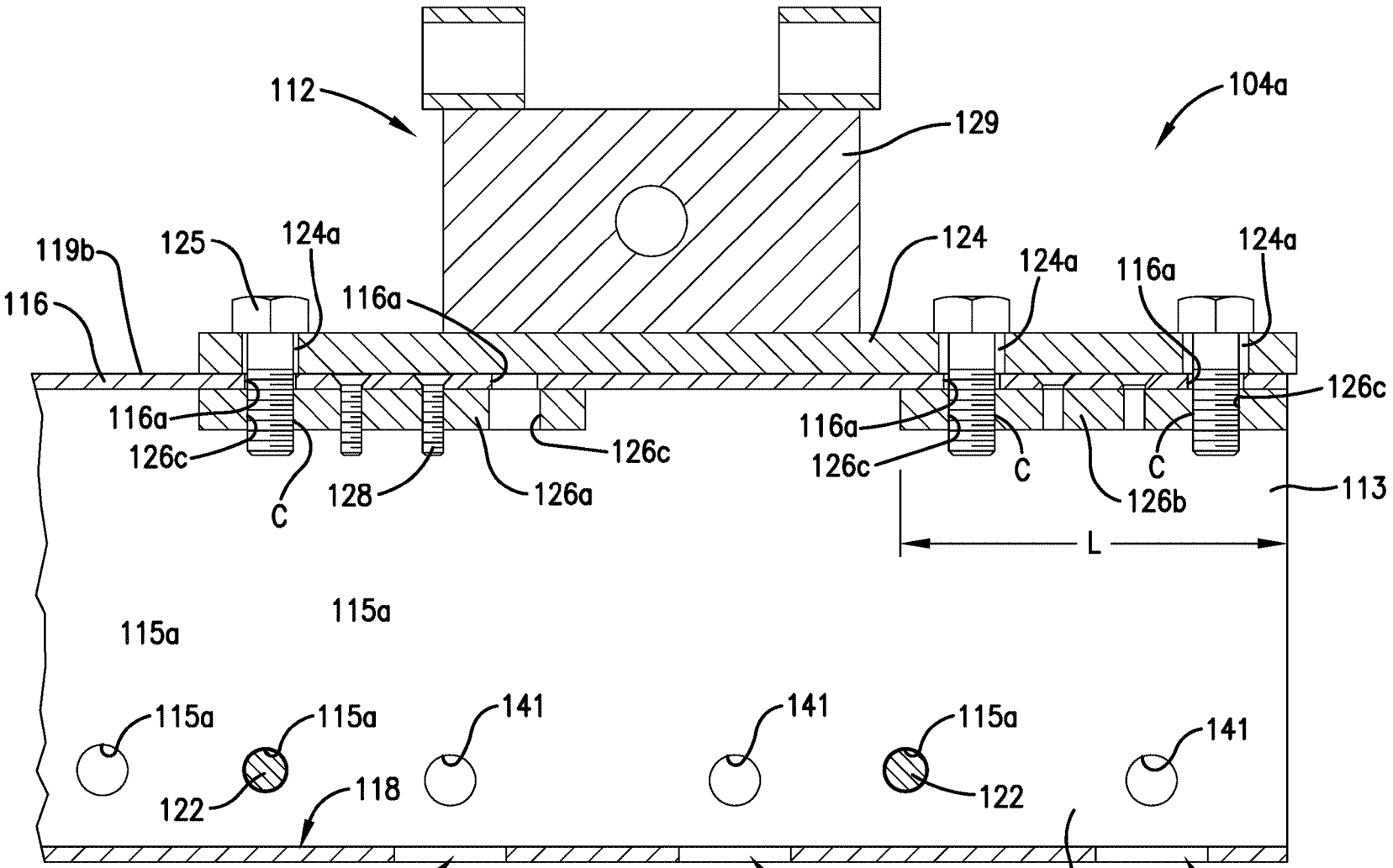
FIG. 9 is a partial side sectional view of the end beam shown in FIG. 6, taken along line 9-9 shown in FIG. 8.
Figure 10:
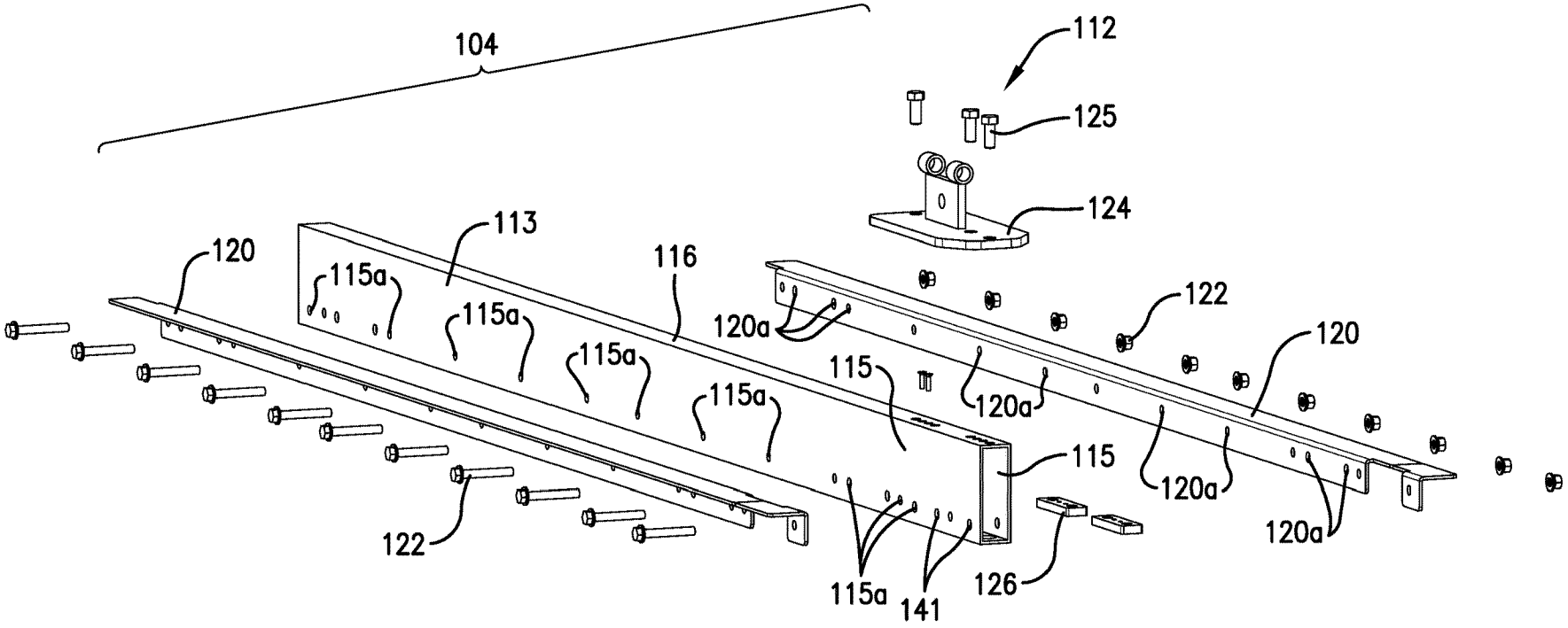
FIG. 10 is an exploded view of the end beam shown in FIG. 6.
Figure 11:
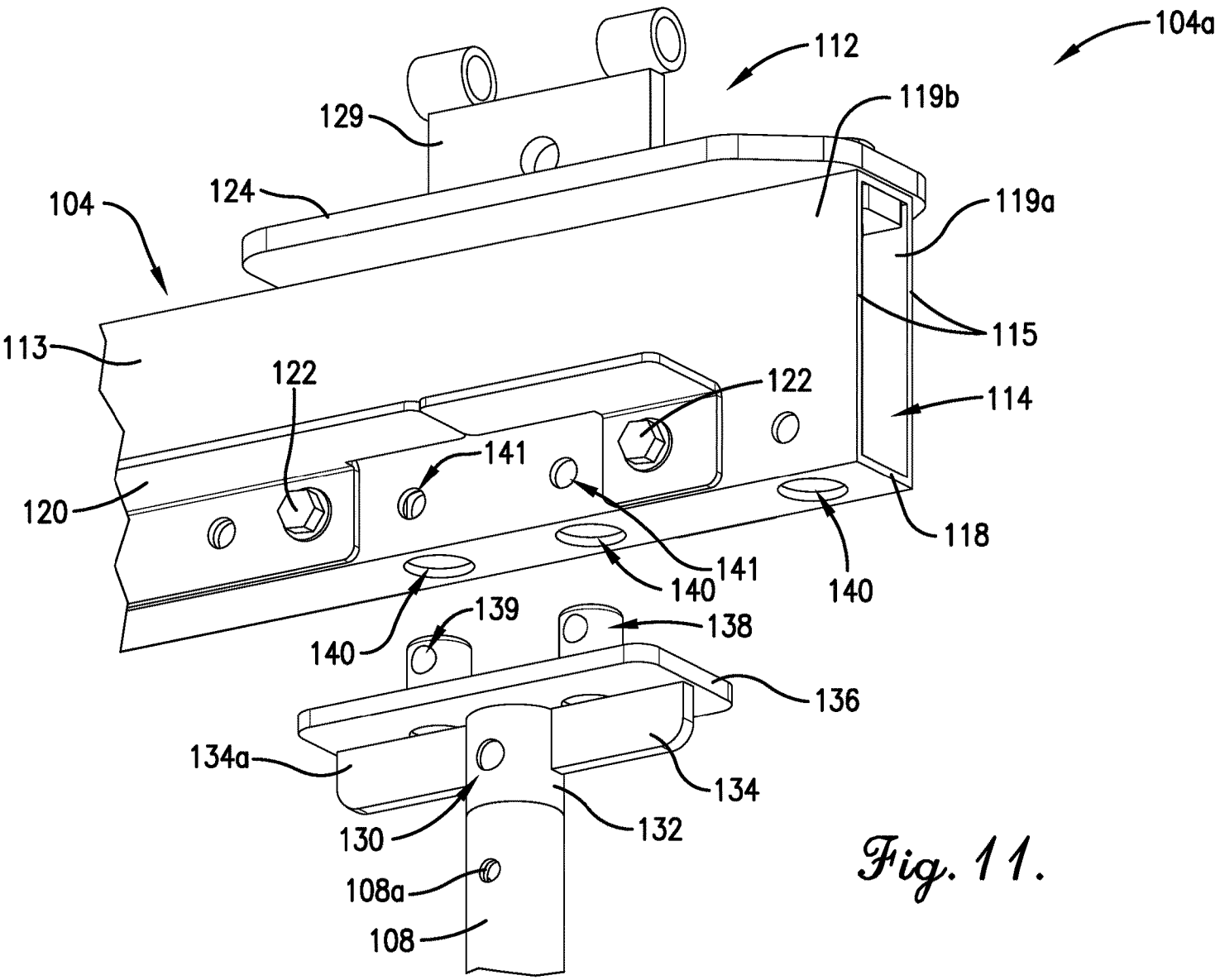
FIG. 11 is a partially-exploded view of the end beam and supporting structure shown in FIG. 3, illustrating in particular detail mating components of the end of the end beam and the saddle.

Turning now to FIG. 9, each tent attachment assembly 112 generally includes a base 124. The base 124 is preferably secured against a corresponding top wall 116 of an end beam 104 using threaded fasteners 125. Base 124 comprises an elongated plate and presents base apertures 124*a* spaced along the length of the plate. The base 124 is configured to be located along the exterior wall surface 119*b* of top wall 116.

In a preferred embodiment, the tent attachment assembly 112 includes one or more boss plates 126*a*, 126*b* inserted along the interior surface 119*a* of the top wall 116 of the end beam 104. The illustrated boss plate 126*b* may be permanently fixed (e.g., via welding) to the top wall 116, while the boss plate 126*a* may be removably attached (e.g., using threaded screws 128) to the top wall 116. However, it is also within the scope of the present invention for the base plates to be alternatively secured to the top wall, e.g., both boss plates 126*a*, 126*b* may be removably attached to the top wall 116 or permanently fixed thereto. The boss plates 126*a*, 126*b* include one or more threaded apertures 126*c* for removably receiving threaded fasteners 125. For certain aspects of the present invention, one or more alternative boss plates may be integrally formed as part of the beam.

End beams 104 present apertures 116*a* in the top wall 116, and the apertures 116*a* are configured to be substantially aligned with respective boss plate apertures 126*c* of the boss plate 126 and respective base apertures 124*a* of the base 124. Preferably, each set of adjacent apertures 116*a*, 124*a*, 126*c* receives a respective fastener 125 and is in substantially coaxial alignment with one another. Substantial alignment of the apertures 116*a*, 124*a*, 126*c* also includes a condition where the threaded fastener 125 extends at least partly through each aperture 116*a*, 124*a*, 126*c*, and at least one aperture is out of coaxial alignment with another aperture. For instance, one or more alternative apertures in the base and/or top wall may comprise an elongated slot that is axially offset from another aperture.

Figure 8:
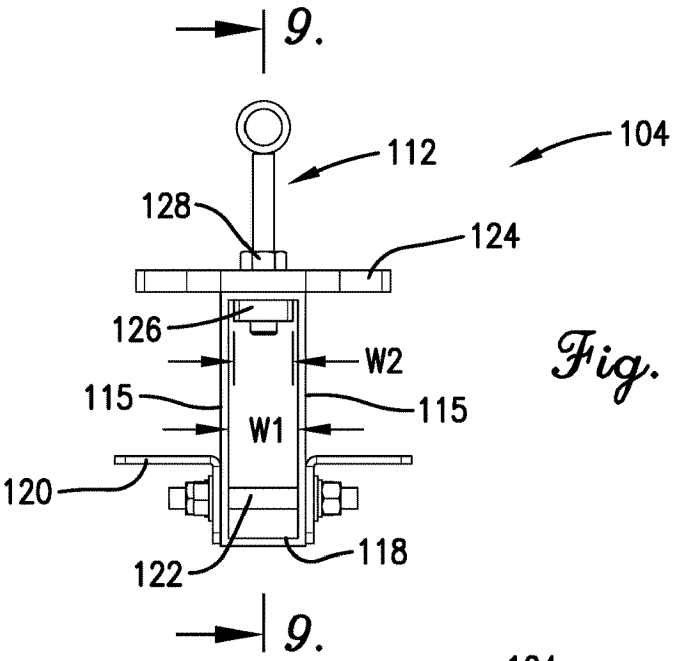
FIG. 8 is an end view of the end beam shown in FIG. 6.

The depicted boss plates 126*a*, 126*b* each define a plate length dimension L (see FIG. 9) and a plate width dimension W2 (see FIG. 8). Plate length dimension L is preferably greater than the interior beam width dimension W1 so that the tubular member 113 restricts rotation of the boss plates 126*a* within the interior beam channel 114. For instance, sidewalls 115 of the illustrated embodiment are configured to cooperatively engage and restrict the boss plates 126*a*, 126*b* from spinning with the threaded fastener 125 during a threading operation.

Figure 7:
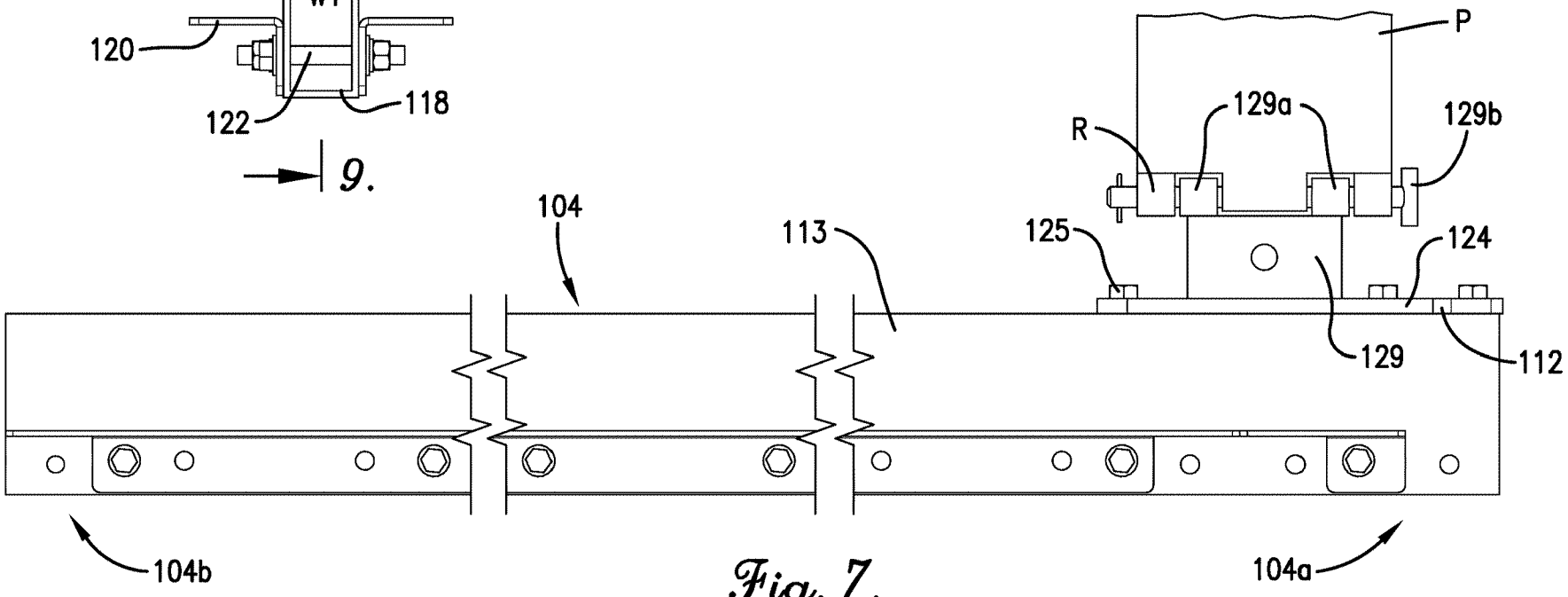
FIG. 7 is a fragmentary side view of the clearspan tent assembly shown in FIG. 1A, showing a tent connector of one tent pole removably connected to the tent attachment assembly by a pin.

Each tent attachment assembly 112 also generally includes a connector 129 configured to engage with a tent pole P of the clearspan tent T (see FIG. 7). The connector 129 is fixed to and extends upward from the base 124. Connector 129 includes a pair of cylindrical sleeve elements 129*a* that receive a pin 129*b* (see FIG. 7). The tent pole P includes a pole connector R with three (3) cylindrical sleeve elements configured to receive the pin 129*b*. Thus, the pin 129*b* is removably inserted through sleeve elements of connector 129 and pole connector R to removably secure the pole P to tent attachment assembly 112. However, a variety of tent attachment structures, which may include an alternative base and/or an alternative connector, may be configured to receive a variety of tent poles without departing from the spirit of the present invention.

The base 124 and connector 129 may be removably fixed to the top wall 116 of the beam 104 using fasteners 125. More particularly, in the preferred embodiment, the fasteners 125 may be one-piece or monolithic fasteners (e.g., comprising a threaded bolt without a nut). The fastener 125 may be extended through the corresponding apertures 124*a*, 116*a* of the base 124 and top wall 116, and threaded into the boss plate 126 at a threaded connection C (see FIG. 9) to secure the base 124 and connector 129 to the top wall 116. While the illustrated fastener 125 is threaded entirely through the aperture 126*c*, alternative flooring system embodiments may have a fastener threaded partly into the boss plate aperture.

Although securement of the base 124 to the top wall 116 is preferred, alternative components of the beam and/or the tent attachment assembly may be attached to one another without departing from the scope of the present invention. For example, an alternative tent attachment assembly may have a vertically extending base element configured for removable attachment to an upright beam wall (such as the sidewall 115 of beam 104).

Securement of fastener 125 is preferably done without the need for a second piece (e.g., a threaded nut) to secure the threaded end of the fastener 125. Threaded connection C preferably has a thread-locking substance located between the threaded fastener and the boss plate. Preferably, the aperture of the boss plate 126 is threaded and is coated or covered with nylon or other locking action substance or thread-locking fluid to resist inadvertent loosening of the fastener 125. The option of omitting a second piece along a threaded end of a fastener 125 (e.g., a nut), in a preferred embodiment, allows for faster and easier removal of the base 124 and connector 129, for example where it is preferred to maintain an interchangeable system for use with various tent types corresponding to various types of connectors 129.

Turning now to FIGS. 11-14, an end beam 104 of a preferred embodiment is supported along an outside or peripheral end by a leg 108. Interposed between the leg 108 and the beam 104 is a saddle 130. The saddle 130 includes a stem 132, gussets 134, and a saddle base 136. Gussets 134 present gusset faces 134*a*, which extend in a substantially vertical plane, and are fixed to the stem 132 and saddle base 136. Saddle base 136 preferably presents a planar base surface 137 extending in a substantially horizontal plane to vertically support one or more beams 104, 106. For certain aspects of the present invention, at least part of an alternative base surface may be nonparallel relative to the horizontal plane (e.g., where at least part of the base surface extends perpendicularly or obliquely relative to the horizontal plane).

The saddle 130 also includes prongs 138 that are fixed to and extend substantially transversely from the base 136. Although the depicted prongs 138 extend substantially vertically, it will be appreciated that one or more alternative prongs (or a portion thereof) may extend upwardly away from the base at an oblique angle relative to a vertical direction. Each prong 138 of the illustrated embodiment also defines a prong axis A1 that is substantially perpendicular to the base surface 137. It is also within the scope of the present invention for an alternative prong (or a portion thereof) to extend away from the base at an oblique angle relative to the base surface. As discussed below, each prong 138 extends in alignment with a respective upright connection axis A2 between the saddle 130 and beam 104, 106.

Although the depicted prongs have a circular cross-sectional profile, one or more prongs may present an alternative profile shape, such as an oblong shape with rounded or square ends, or a polygonal shape (e.g., triangular, square, rectangular, hexagonal, etc.). Most preferably, the prongs and the respective apertures are complementally shaped.

In the depicted embodiment, each prong 138 defines a transverse aperture 139 extending therethrough. The stem 132 of each saddle 130 may include a shoulder 133 (see FIGS. 13 and 14) demarcating a bottom, narrowed length configured to be received within a corresponding length of the leg 108 in a telescoping relationship. The shoulder 133 of the stem 132 may present a larger diameter than the inner diameter of the end of the leg 108, such that the narrowed length of the stem 132 may be inserted into the end of the leg 108 until the shoulder of the stem 132 engages with and rests on the end of the leg 108. In this manner, the leg 108 may support the saddle 130 along the shoulder of the stem 132, restricting all but upward movement of the saddle 130 with respect to the leg 108.

The bottom wall 118 of the beam 104 defines apertures 140 adjacent the respective ends 104*a*, 104*b* of each end beam 104. Each aperture 140 is of sufficient diameter, and is configured, to receive one of the prongs 138.

Figure 15:
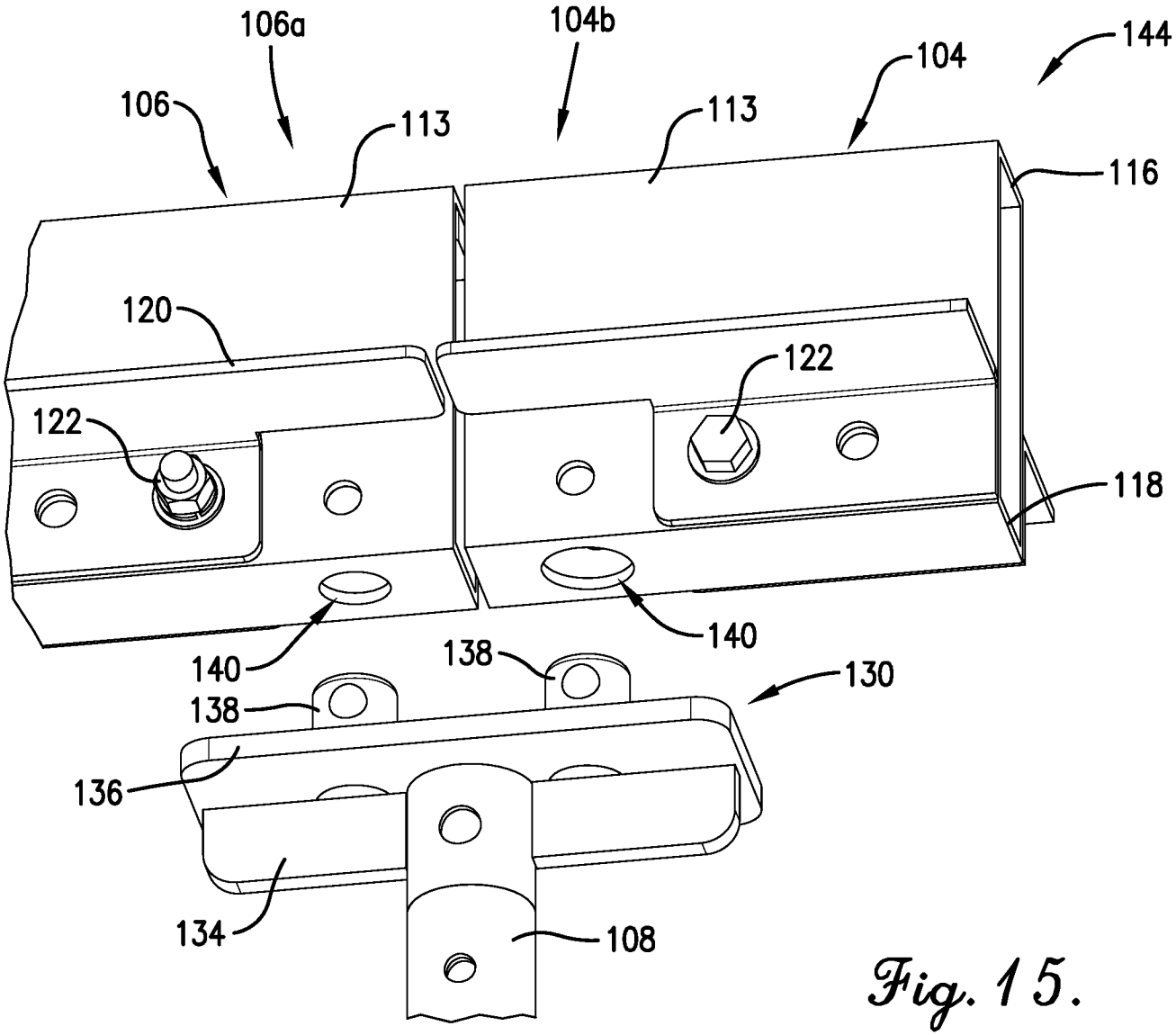
FIG. 15 is a partially-exploded view of the juncture between the end beam and intermediate beam shown in FIG. 4, illustrating in particular detail mating components of the respective beams and the saddle.

Preferably, a pair of apertures 140 are located adjacent the outboard end 104*a* (see FIG. 11), and a single aperture 140 is located adjacent the inboard end 104*b* (see FIG. 15). However, alternative embodiments of the end beam may have an alternative arrangement of apertures adjacent to one or both of the beam ends. For instance, one or both of the beam ends may have a greater or fewer number of apertures compared to the depicted embodiment. While the depicted apertures are preferably located adjacent the beam ends, one or more apertures may be provided at one or more intermediate locations spaced between the depicted aperture locations. For instance, one or more intermediate aperture locations may be provided to provide supplemental support to the beam, to accommodate a longitudinally overlapping arrangement of beams, and/or for other purposes. Although the depicted apertures are circular, one or more apertures may present an alternative aperture shape, such as an elongated slot with rounded or square ends, or a polygonal shape (e.g., triangular, square, rectangular, hexagonal, etc.). Again, most preferably, the prongs and the respective apertures are complementally shaped.

The depicted apertures 140 are preferably located in the bottom wall 118, but alternative flooring system configurations may have one or more apertures located in a wall structure other than a bottom wall or lowermost wall of a beam. For instance, alternative beam embodiments may have one or more apertures located in a downwardly facing wall spaced between uppermost and lowermost margins of the beam.

Figure 12A:
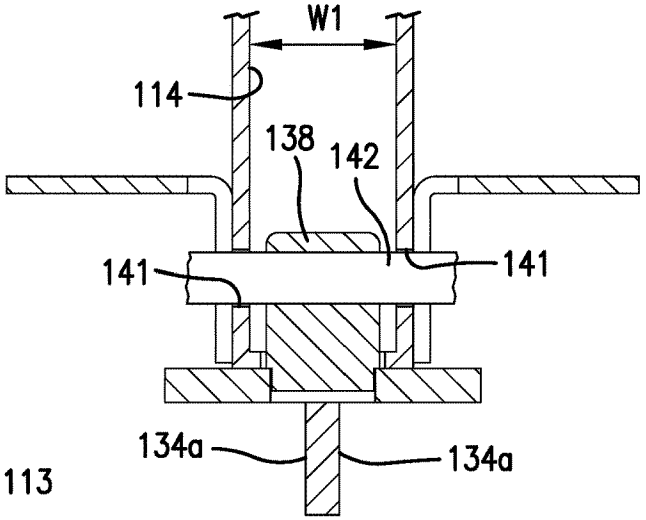
FIG. 12A is a fragmentary cross-sectional view of the end beam taken along line 12A-12A in FIG. 12.
Figure 12:
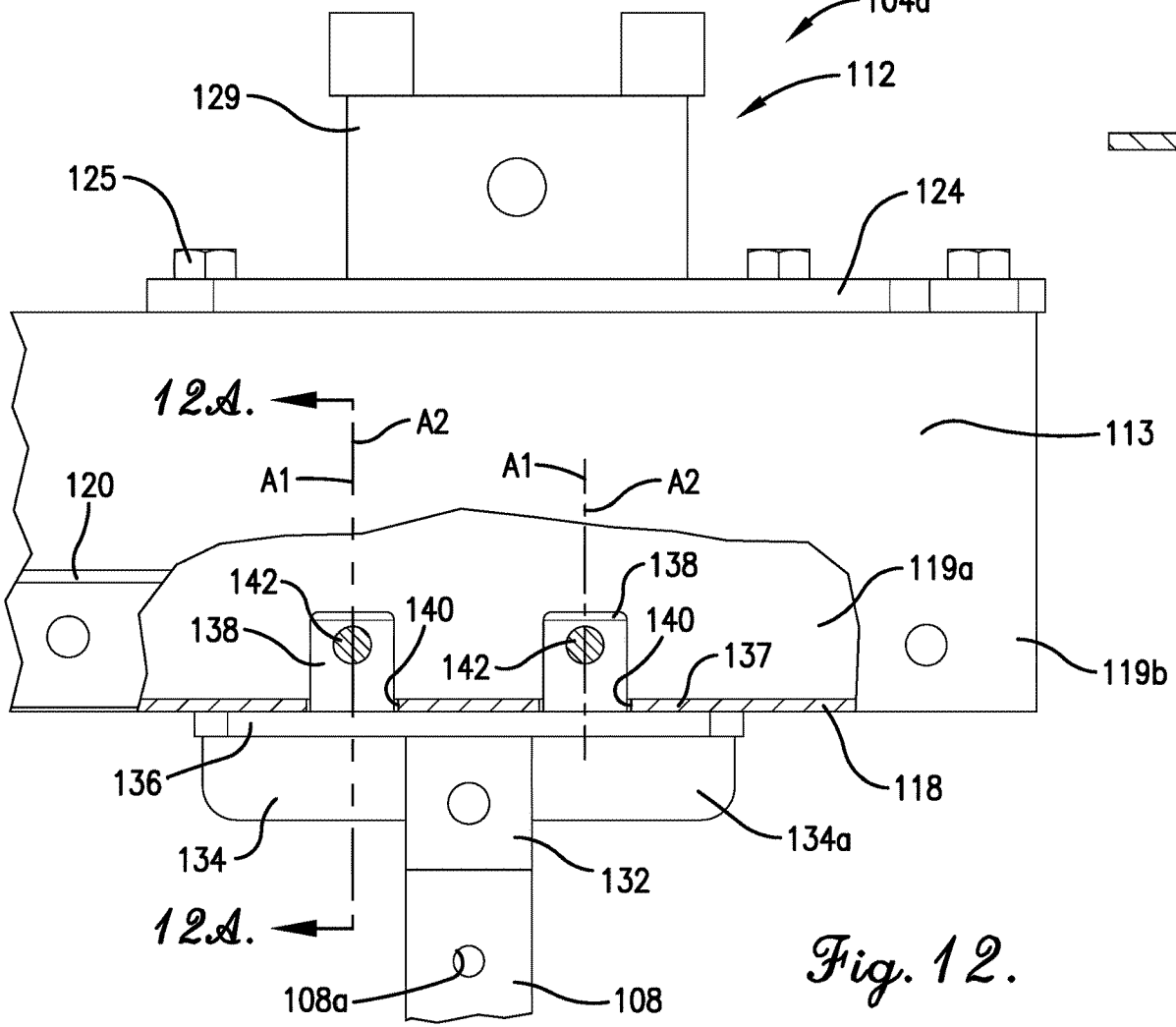
FIG. 12 is a fragmentary side view of the end beam and supporting structure shown in FIG. 3, illustrating in particular detail the end of the end beam mounted to the saddle.
Figure 14:
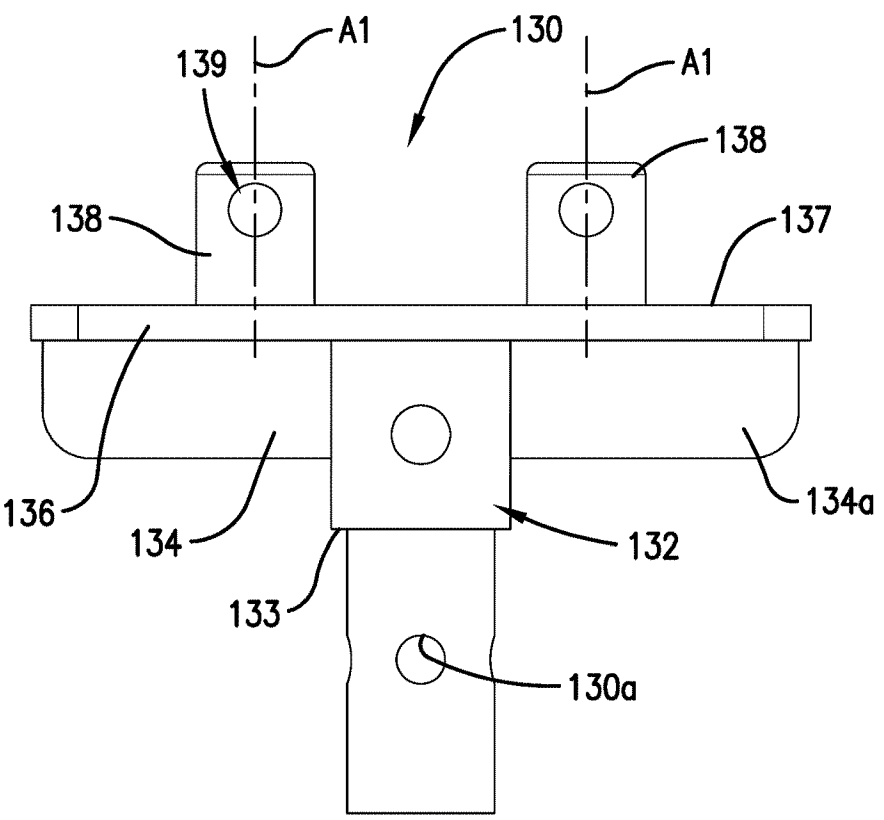
FIG. 14 is a side view of the saddle shown in FIG. 13.
Figure 13:
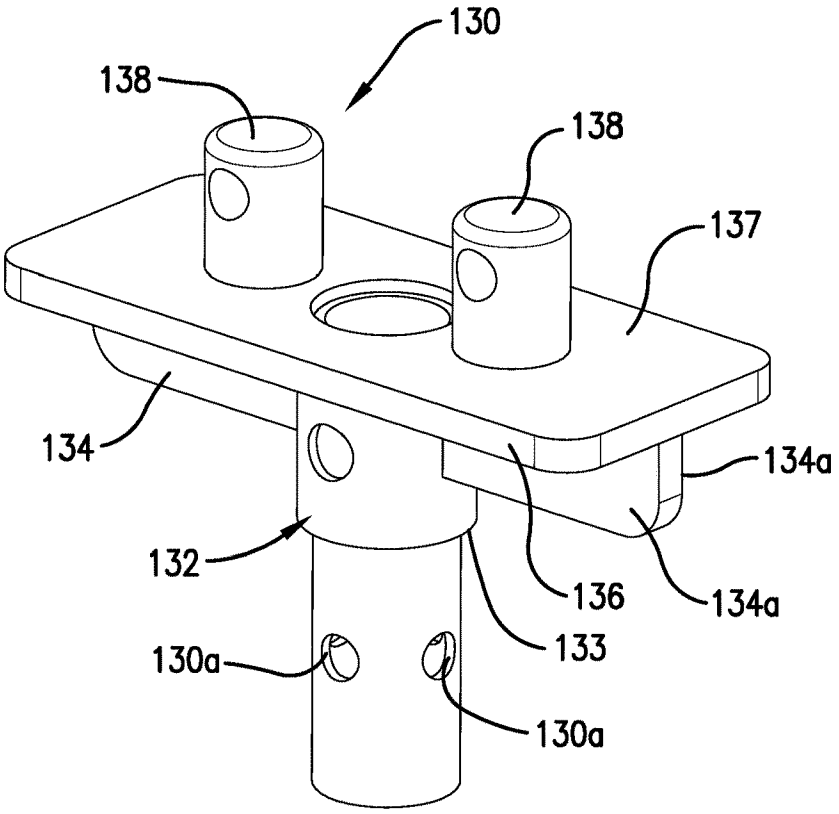
FIG. 13 is a perspective view of the saddle of the elevated flooring system shown in FIG. 1B.

Turning more particularly to FIGS. 12 and 12A, outboard end 104*a* of the end beam 104 is placed above the saddle 130, apertures 140 are aligned with respective prongs 138, and the end beam 104 is lowered to rest on the base surface 137 of the saddle 130. In this manner, the saddle 130 may support the beam 104, restricting all movement except for upward movement of the end beam 104 with respect to the saddle 130 along the connection axis A2. Inboard end 104*a* of the end beam 104 is similarly lowered to rest on the base surface 137 of a corresponding saddle 130 (see FIG. 16).

Each prong 138 is slidably received into and out of a respective aperture 140 such that vertical lifting of the corresponding end beam 104 relative to the saddle 130 disengages and removes the prong 138 from the respective one of the apertures 140. That is, the illustrated beam 104 is moved in an upward disengagement direction aligned with the connection axis A2 (see FIG. 12). It is also within the ambit of the present invention for the beam 104 to be disengaged by moving the beam in an alternative disengagement direction (such as a disengagement direction arranged at an oblique angle relative to vertical when the prong alternatively extends obliquely from the base surface).

It should also be noted that upward movement of the saddle 130 with respect to the leg 108, and/or of the end beam 104 with respect to the saddle 130, may be additionally restricted in one or more embodiments. More particularly, one or both of the sidewalls 115 may define apertures 141 aligned with the apertures 139 of the prongs 138 (see FIGS. 9 and 12A), such that a clip, pin, bolt or other fastener may by fitted through the complementary apertures 139, 141 to restrict upward movement of the end beam 104 with respect to the saddle 130. For instance, locking fasteners 142 (see FIGS. 12 and 12A) are removably inserted through respective prongs 138 and end beam 104 along a direction transverse to the upright connection axis A2 to restrict beam movement in the disengagement direction.

Likewise, in alternative embodiments of the flooring system, telescoping segments of the saddle 130 and/or the leg 108 may respectively define aligned apertures 130*a*, 108*a* (see FIGS. 11-14) through which such fasteners (not shown) may be fitted to restrict upward movement of the saddle 130 with respect to the leg 108.

Figure 16:
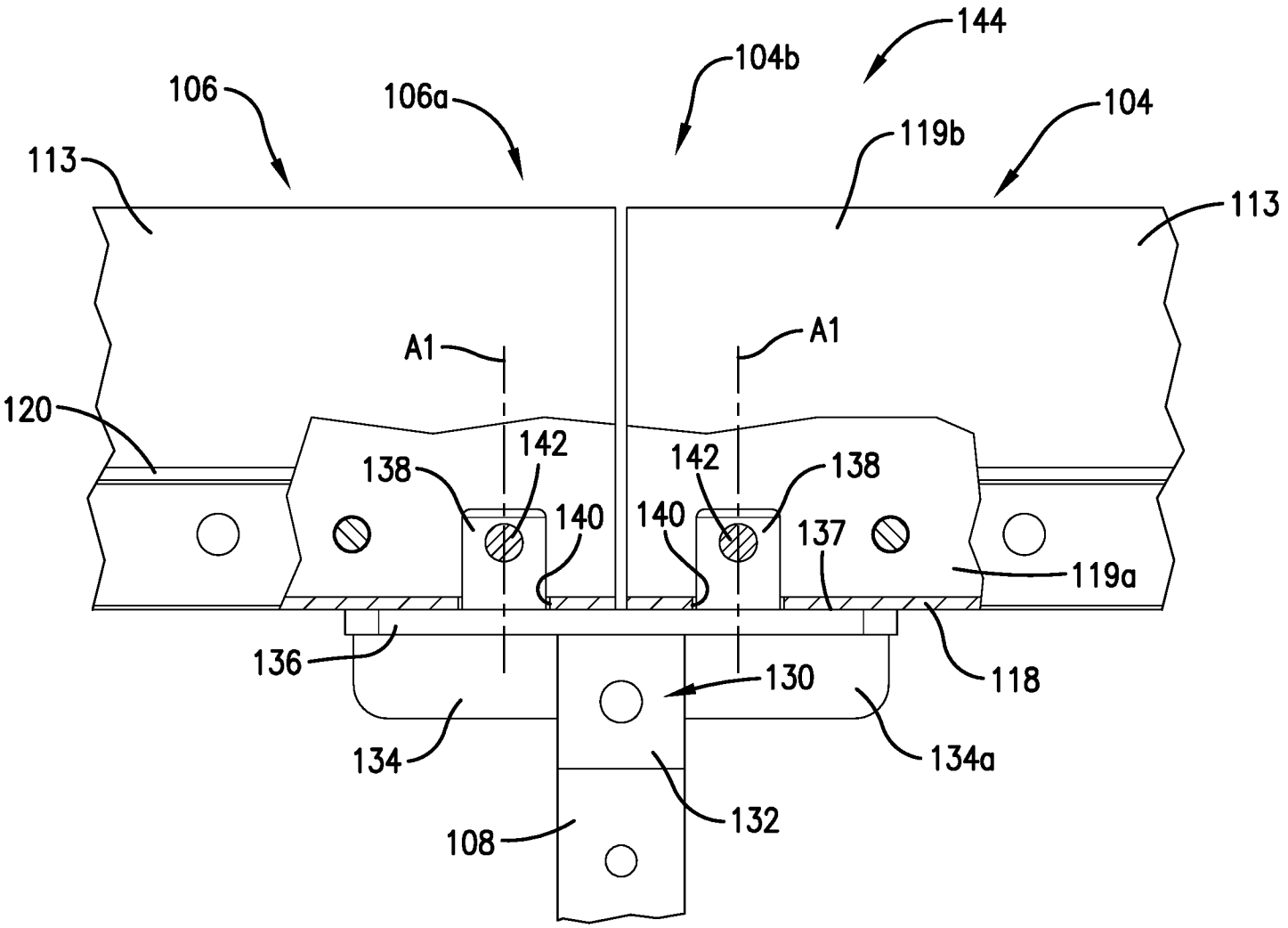
FIG. 16 is a fragmentary side view of the juncture between end beam and intermediate beam shown in FIG. 4, illustrating in particular detail the beams mounted to the saddle.

Turning now to FIGS. 15-16, substantially the same engagement described above between saddle 130 and an outer end of an end beam 104 is shown at a juncture 144 between an end 106*a* of intermediate beam 106 and an inboard end 104*b* of an end beam 104. More particularly, each of the end and intermediate beams 104, 106 includes a bottom wall 118 defining an aperture 140 therethrough.

At each of the depicted junctures 144, a corresponding saddle 130 is attached to and interposed between adjacent beam ends 104*b*, 106*a* of respective beams 104, 106. In the illustrated embodiment, adjacent beam ends 104*b*, 106*a* are connected by the saddle 130 in a generally abutting arrangement. Each pair of abutting beam ends 104*b*, 106*a* are depicted as not touching one another, so that a small gap is defined between the abutting beam ends 104*b*, 106*a*. However, it is also within the ambit of the present invention for abutting beam ends to directly contact one another when assembled on the respective saddle 130.

It is also within the ambit of certain aspects of the present invention for beams of a set to be arranged in a non-abutting relationship. For instance, as discussed above, beams of a set may at least partly overlap with one another along the longitudinal beam direction. In such alternative embodiments, it will be appreciated that a saddle interconnecting the overlapping beams may be oriented relative to the beams and may be attached to the beams at various locations along the length of the beams other than the depicted locations.

Although each juncture 144 of the depicted flooring system includes a pair of beams attached to the respective saddle, alternative embodiments may include a juncture with more than two (2) beams interconnected by a saddle at the juncture. For instance, adjacent, longitudinally extending sets of beams may be interconnected by a laterally extending beam that is supported at a respective juncture of each set. In such alternative embodiments, one or more laterally extending beams may extend perpendicularly to the longitudinal direction of the sets and/or at an oblique angle to the longitudinal direction.

Again, the end beam 104 preferably includes a single aperture 140 located adjacent the inboard end 104*b*. The depicted intermediate beam preferably includes ends 106*a* with a respective aperture 140 located adjacent thereto. Alternative embodiments of the intermediate beam may have an alternative arrangement of apertures adjacent to one or both of the beam ends. For instance, in alternative embodiments, the intermediate beam may have apertures in both top and bottom walls so that the intermediate beam may be used in an inverted (that is, flipped over) orientation. Alternative embodiments of the intermediate beam may have an alternative aperture arrangement similar to the alternative aperture configurations discussed above with respect to the end beam.

With respect to the depicted juncture 144, one of the prongs 138 of saddle 130 is inserted through the aperture 140 of intermediate beam 106, and the other prong 138 is inserted through the aperture 140 of end beam 104. The end beam 104 and intermediate beam 106 are each lowered to rest on the base surface 137 of the saddle 130. In this manner, the saddle 130 may support the beams 104, 106, restricting all movement except for upward movement of the beams 104, 106 with respect to the saddle 130 the connection axis A2. Each prong 138 is slidably received into and out of a respective aperture 140 such that vertical lifting of the corresponding beam 104, 106 relative to the saddle 130 disengages and removes the prong from the respective one of the apertures 140. That is, the illustrated beam 104, 106 is moved in an upward disengagement direction aligned with the connection axis A2. Again, it is within the ambit of the present invention for the beam 104, 106 to be disengaged by moving the beam in an alternative disengagement direction (such as a disengagement direction arranged at an oblique angle relative to vertical when the prong alternatively extends obliquely from the base surface).

One of ordinary skill will appreciate that structures for restricting upward movement of the beam 106 with respect to the saddle 130 (as discussed above) may also be employed at the juncture 144 to restrict such upward movement of beams 104, 106. For instance, locking fasteners 142 are removably inserted through respective prongs 138 and beams 104, 106 (see FIG. 16) along a direction transverse to the upright connection axis A2 to restrict beam movement in the disengagement direction.

It should be appreciated that substantially the same engagement described above with respect to the juncture 144 between an intermediate beam 106 and an inboard end 104*b* of an end beam 104—including with respect to components for intercoupling each of the beams 104, 106 with a saddle 130—would also be utilized at a juncture between two intermediate beams 106 in embodiments that include multiple intermediate beams 106 in a set 102.

As noted above, adjacent beams 104, 106 support respective flooring panels F. For instance, the beams 104, 106 cooperatively forming a juncture (such as juncture 144), and supported by a common saddle 130, may be configured to support respective flooring panels F. However, it is within the ambit of the present invention for the beams 104, 106 of the juncture 144 to support a common flooring panel, such that a single flooring panel spans from one beam 104 to the other beam 106 of the juncture 144.

Preferably, each beam 104, 106 is primarily or only engaged so as to be supported by underlying support structure and/or saddle(s) 130, and is not fastened directly to or engaged in a supporting relationship with a corresponding adjacent beam 104, 106. That is, each one of multiple adjacent beams is preferably devoid of structure that is directly attached to another one of the adjacent beams. For instance, adjacent beams are preferably devoid of structure (such as a sidewall and/or flange) that extends into and/or nests with another one of the adjacent beams for providing direct attachment of adjacent beams. For at least certain aspects of the present invention, at least one of the junctures may have alternative beams that are directly connected to one another, but the depicted flooring system is preferably devoid of such connections.

Furthermore, in the illustrated embodiment, a single saddle is preferably the sole support structure of the flooring system extending between and attaching to each of the adjacent beams, such that the adjacent beams are not otherwise directly connected to each other by the flooring system. However, for at least certain aspects of the present, at least one of the junctures may have additional support structure that extends between and attaches to each of the adjacent beams. For instance, an alternative juncture may have multiple saddle elements that each extend between and attach to both of the adjacent beams.

In operation, each set 102 of beams 104, 106 may be selectively supported on legs 108 by engaging the beams 104, 106 with corresponding saddles 130. Outboard ends 104*a* of end beams 104 are lowered onto outboard saddles 130, while inboard ends 104*b* of end beams 104 are lowered onto inboard saddles 130. Opposite ends 106*a* of intermediate beams 106 are lowered onto respective inboard saddles 130. Respective beam ends 104*b*, 106*a* are engaged with corresponding saddles to cooperatively form the junction 144. Locking fasteners 142 may be removably inserted through respective prongs 138 and beams 104, 106 to secure the saddle 130 thereto and restrict beam disengagement from the saddle 130.

The base 124 and connector 129 of tent attachment assembly 112 may be removably secured adjacent to outboard ends of sets 102 with fasteners 125. The base 124 is located so that base apertures 124*a* are brought into substantial alignment with corresponding apertures 116*a* of the top wall 116 and corresponding boss plate apertures 126*c*. Fasteners 125 are inserted into each adjacent set of apertures 116*a*, 124*a*, 126*c* and threaded into the threaded boss plate apertures 126*c*. The tent attachment assembly 112 may be secured to the outboard ends of sets 102 before or after the beams 104, 106 are intercoupled with the saddles 130. The tent pole P may then be connected to the tent attachment assembly 112. In the illustrated embodiment, the tent pole P is attached to the tent attachment assembly 112 by positioning the sleeve elements of the pole connector R adjacent to the sleeve elements 129*a* of the connector 129 (preferably, so that the sleeve elements 129*a* of the connector 129 are coaxially aligned with the sleeve elements of the respective pole connector R) and inserting the pin 129*b* through the sleeve elements 129*a* and the sleeve elements of pole connector R.

Although the above description presents features of preferred embodiments of the present invention, other preferred embodiments may also be created in keeping with the principles of the invention. Furthermore, these other preferred embodiments may in some instances be realized through a combination of features compatible for use together despite having been presented independently in the above description.

The preferred forms of the invention described above are to be used as illustration only and should not be utilized in a limiting sense in interpreting the scope of the present invention. Obvious modifications to the exemplary embodiments, as hereinabove set forth, could be readily made by those skilled in the art without departing from the scope of the present invention.

In this description, references to "one embodiment," "an embodiment," or "embodiments" mean that the feature or features referred to are included in at least one embodiment of the invention. Separate references to "one embodiment," "an embodiment," or "embodiments" in this description do not necessarily refer to the same embodiment and are not mutually exclusive unless so stated. Specifically, a feature, structure, act, etc. described in one embodiment may also be included in other embodiments but is not necessarily included. Thus, particular implementations of the present invention can include a variety of combinations and/or integrations of the embodiments described herein.

Furthermore, directional references (e.g., top, bottom, front, back, side, up, down, etc.) are used herein solely for the sake of convenience and should be understood only in relation to each other. For instance, a component might in practice be oriented such that faces referred to as "top" and "bottom" are sideways, angled, inverted, etc. relative to the chosen frame of reference.

It is also noted that, as used herein, the terms axial, axially, and variations thereof mean the defined element has at least some directional component along or parallel to the axis. These terms should not be limited to mean that the element extends only or purely along or parallel to the axis. For example, the element may be oriented at a forty-five degree (45°) angle relative to the axis but, because the element extends at least in part along the axis, it should still be considered axial. Similarly, the terms radial, radially, and variations thereof shall be interpreted to mean the element has at least some directional component in the radial direction relative to the axis.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order recited or illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein. The foregoing statements in this paragraph shall apply unless so stated in the description and/or except as will be readily apparent to those skilled in the art from the description.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

The detailed description is to be construed as exemplary only and does not describe every possible embodiment because describing every possible embodiment would be impractical. Numerous alternative embodiments may be implemented, using either current technology or technology developed after the filing date of this patent, which would still fall within the scope of the claims.

Although the disclosure has been described with reference to the embodiments illustrated in the attached figures, it is noted that equivalents may be employed, and substitutions made herein, without departing from the scope of the disclosure as recited in the claims.

The invention claimed is:

1. An elevated flooring system operable to support a flooring panel, said elevated flooring system comprising:

a saddle including a base surface and a plurality of prongs extending upwardly away from the base surface;

a plurality of beams engaged with and vertically supported by the base surface of the saddle, each of said beams being configured to support the flooring panel and defining an aperture configured to receive a respective one of the plurality of prongs, each of said prongs extending through a respective one of the apertures to restrict horizontal movement of the corresponding beam relative to the saddle, each of said prongs extending in alignment with an upright connection axis, each of said prongs being slidably received into and out of the respective one of the apertures such that vertical lifting of the corresponding beam relative to the saddle removes the prong from the respective one of the apertures; and a locking fastener extending through one of the prongs and the corresponding beam along a direction transverse to the upright connection axis, with the locking fastener removably securing the one prong and the corresponding beam to restrict movement of the corresponding beam relative to the saddle in the disengagement direction.

2. The elevated flooring system as claimed in claim 1, said saddle and said beams cooperatively restricting movement of the beams relative to the saddle in all but a disengagement direction that extends away from the saddle and is aligned with the upright connection axis.

3. The elevated flooring system as claimed in claim 1, said saddle including a saddle base fixed to and supporting the prongs, said saddle base presenting the base surface, with the base surface being substantially planar.

4. The elevated flooring system as claimed in claim 1, each of said beams defining opposite beam ends, with each beam end presenting a corresponding one of the apertures.

5. The elevated flooring system as claimed in claim 4, said saddle being attached to and interposed between adjacent ones of the opposite beam ends of two of the plurality of beams.

6. The elevated flooring system as claimed in claim 5, said adjacent beam ends abutting one another, with the corresponding two of the plurality of beams being coaxially arranged relative to each other.

7. An elevated flooring system operable to support a flooring panel, said elevated flooring system comprising:

a saddle including a base surface and a plurality of prongs extending upwardly away from the base surface;

a plurality of beams engaged with and vertically supported by the base surface of the saddle, each of said beams being configured to support the flooring panel and defining an aperture configured to receive a respective one of the plurality of prongs, each of said prongs extending through a respective one of the apertures to restrict horizontal movement of the corresponding beam relative to the saddle, each of said beams being tubular, said beam including spaced sidewalls and a bottom wall that extends between the sidewalls, with the apertures extending through the bottom wall, each of said prongs extending in alignment with an upright connection axis, each of said prongs being slidably received into and out of the respective one of the apertures such that vertical lifting of the corresponding beam relative to the saddle removes the prong from the respective one of the apertures; and a locking fastener extending through one of the prongs and the corresponding beam along a direction transverse to the upright connection axis, with the locking fastener removably securing the one prong and the corresponding beam to restrict movement of the corresponding beam relative to the saddle in the disengagement direction.

8. The elevated flooring system as claimed in claim 7, each of said beams being devoid of structure that extends into another one of said beams.

9. An elevated flooring system operable to support a flooring panel and to engage a tent assembled atop the elevated flooring system, said elevated flooring system comprising:

a beam configured to support the flooring panel, said beam including a tent attachment assembly and a beam wall defining an aperture and opposite wall surfaces, said tent attachment assembly configured for attachment to the tent and including a base, a boss plate, and a threaded fastener, said base and said boss plate being respectively located along the wall surfaces of the beam wall and each presenting an aperture, said apertures of the base, boss plate and beam wall being substantially aligned, said fastener extending at least partly through the apertures of the base, boss plate and beam wall and being threaded into the boss plate, with the fastener and boss plate cooperatively providing a clamping engagement about the opposite wall surfaces of the beam wall to secure the tent attachment assembly, said beam being tubular, said beam presenting an interior beam channel associated with one of the wall surfaces, said beam including spaced sidewalls that define an interior beam width dimension of the beam channel, with the beam wall comprising a top wall that extends between the sidewalls, said boss plate being fixed to the top wall and located within the beam channel.

10. The elevated flooring system as claimed in claim 9, said boss plate being removably attached to the beam wall with a threaded screw, with the screw being threaded into the boss plate.

11. The elevated flooring system as claimed in claim 9, said threaded fastener being secured to said boss plate without a threaded nut.

12. The elevated flooring system as claimed in claim 9, said threaded fastener and said boss plate being joined to one another at a threaded connection, with the connection having a thread-locking substance applied between the threaded fastener and the boss plate.

13. The elevated flooring system as claimed in claim claim 9, said boss plate defining a plate length dimension and a plate width dimension, said plate length dimension being greater than the interior beam width dimension, with at least one of the sidewalls configured to engage and restrict the boss plate from spinning with the threaded fastener during a threading operation.

14. An elevated flooring system operable to support a flooring panel and to engage a tent assembled atop the elevated flooring system, said elevated flooring system comprising:

a beam configured to support the flooring panel, said beam including a tent attachment assembly and a beam wall defining an aperture and opposite wall surfaces, said tent attachment assembly configured for attachment to the tent and including a base, a boss plate, and a threaded fastener, said base and said boss plate being respectively located along the wall surfaces of the beam wall and each presenting an aperture, said apertures of the base, boss plate and beam wall being substantially aligned, said fastener extending at least partly through the apertures of the base, boss plate and beam wall and being threaded into the boss plate, with the fastener and boss plate cooperatively providing a clamping engagement about the opposite wall surfaces of the beam wall to secure the tent attachment assembly, said beam being tubular, said beam presenting an interior beam channel associated with one of the wall surfaces, said beam including spaced sidewalls that define an interior beam width dimension of the beam channel, with the beam wall comprising a top wall that extends between the sidewalls, said boss plate being removably attached to the top wall with another fastener and located within the beam channel.

15. The elevated flooring system as claimed in claim 14, said boss plate being fixed to the beam wall.

* * * * *